United States Patent [19]

Price

[11] 4,364,626

[45] Dec. 21, 1982

[54] ELECTRICAL CONNECTOR

[75] Inventor: Edison A. Price, New York, N.Y.

[73] Assignee: Edison Price Incorporated, New York, N.Y.

[21] Appl. No.: 128,167

[22] Filed: Mar. 7, 1980

[51] Int. Cl.[3] ..... H01R 13/64

[52] U.S. Cl. ..... 339/184 M; 339/14 P

[58] Field of Search ..... 339/184 R, 184 M, 185 R, 339/186 R, 217 S, 14 R, 14 P

[56] References Cited

U.S. PATENT DOCUMENTS

| | | | |
|---|---|---|---|
| 398,769 | 2/1889 | Currie | 339/184 R X |
| 2,386,177 | 10/1945 | Andersen | 339/184 M X |
| 3,670,289 | 6/1972 | Bruner | 339/186 R X |
| 3,824,524 | 7/1974 | Glover | 339/184 R X |
| 4,193,655 | 3/1981 | Herrmann, Jr. | 339/186 M X |
| 4,245,875 | 1/1981 | Shaffer et al. | 339/184 M X |

FOREIGN PATENT DOCUMENTS

| | | | |
|---|---|---|---|
| 490086 | 4/1927 | Fed. Rep. of Germany | 339/14 P |
| 911424 | 5/1961 | United Kingdom | 339/14 R |

*Primary Examiner*—John McQuade
*Assistant Examiner*—Frank H. McKenzie, Jr.
*Attorney, Agent, or Firm*—McAulay, Fields, Fisher, Goldstein & Nissen

[57] ABSTRACT

An electrical connector has electrically conducting contact members with interengaging ends for interengagement with other contact members; and an outer insulating support housing. The support housing is in the form of a base and an array of projections extending upwardly from the base. The array of projections include at least one small size projection and one large size projection, with the large size projection having a large bore in the forward end, sized to receive the forward end of the small size projection. The small size projection has a small bore in its forward end. Supported in the bores are contact members with their interengagement ends extending into the bores so that when the small projection and large projection of two connectors are interengaged, the contact members are engaged to complete an electric circuit therebetween.

9 Claims, 5 Drawing Figures

ELECTRICAL CONNECTOR

BACKGROUND OF THE INVENTION

This invention relates to a connector for mobile lighting fixtures. More particularly, the present invention relates to a connector which provides for convenient plug-in connect and disconnect of single or multiple fixture arrangements, thereby eliminating hard wiring of the fixtures and consequent immobility thereof.

There has recently been an increased demand for non-permanently mounted fixtures, both in industry and for home use. The present invention provides a means whereby a fixture or multiple fixtures can be connected to or disconnected from the power source by a releasable connector. This facilitates changes in the type of fixtures if this becomes desirable because of changes in the use of various lighted areas.

Furthermore, to control the use of energy, it has become a normal practice, in both commercial and private installations, to provide a number of electrical switches for any large array of lighting fixtures. Each switch is wired to control predetermined ones of the fixtures in the array. Thus, for example, a low-lighting situation can be accomplished by wiring one switch to a checkerboard-connected pattern of lights or to every third light in adjacent rows. To turn on all of the lights would require all of the switches to be thrown. Various patterns can be wired to each switch, depending upon the lighting needs at various times. In order to change the array of lights controlled by each switch, it is necessary to have an electrician disconnect the hard wiring and rearrange or rewire the array. This can be a particularly great problem when, as is usual, fluorescent lighting fixtures are paired together with only one of the pair, that is, the so-called master, having the necessary ballast to trigger the fluorescent tubes, while the other of the pair (the so-called slave) requires that it be wired to a master unit for operation. If for some reason it becomes desirable to control the master and the slave unit by different switches, the slave unit will have to be rewired to a new master unit for operation. This, again, requires that the hard wiring be opened and the array be reconnected as required.

Additionally, lighting fixtures which are removably connected in place produce certain major advantages. In addition to increasing the ease of removal, installation, or relocation, these fixtures are treated as furniture for tax purposes, rather than as permanent fixtures, and thereby provide increased benefits attendant this type of tax treatment.

Although connectors for making removable connections are known, they suffer from a number of disadvantages which make their use with lighting fixture arrays impractical. To be practical for use with an array of lighting fixtures, a connector should be capable of handling at least five or six separate circuits and still be able to pass through a standard access hole normally found in lighting fixtures. The connector should be polarized to ensure proper mating between the power conductors and the various fixtures. Prior polarized devices, capable of being adapted to handle five or six circuits while maintaining the size considerations necessary to fit through a standard access hole (normally $\frac{7}{8}$ inch), are unknown. In addition, known polarized connector designs have separate male and female plug connector portions, requiring that an inventory of both connector portions be available for use for interconnection with existing wiring.

It is therefore an object of the present invention to provide a connector construction which can accommodate a plurality of circuits within a connector construction capable of fitting through a standard access opening in an electrical fixture.

It is a further object of the invention to provide a connector which is hermaphroditic and polarized. That is, the present invention provides a connector which contains both male and female portions which can be easily adapted to mate with another identical connector and only in one orientation.

SUMMARY OF THE INVENTION

Briefly, the invention is an electrical connector having electrically conducting contact members with an interengaging end for interengagement with other contact members; and an outer insulating support housing. The support housing is formed with a base and an array of projections extending upwardly from the base. The array of projections comprises at least one small size projection and one large size projection, the large size projection having a large bore in the forward end thereof sized to receive the forward end of the small size projection. The small size projection also has a small bore in its forward end. Supported within the projections are the electrical contact members with their interengagement ends extending into the bores so that when the small projections and large projections of two connectors are interengaged, the contact members are engaged to complete an electric circuit therebetween.

DESCRIPTION OF PREFERRED EMBODIMENT

Figure 1:
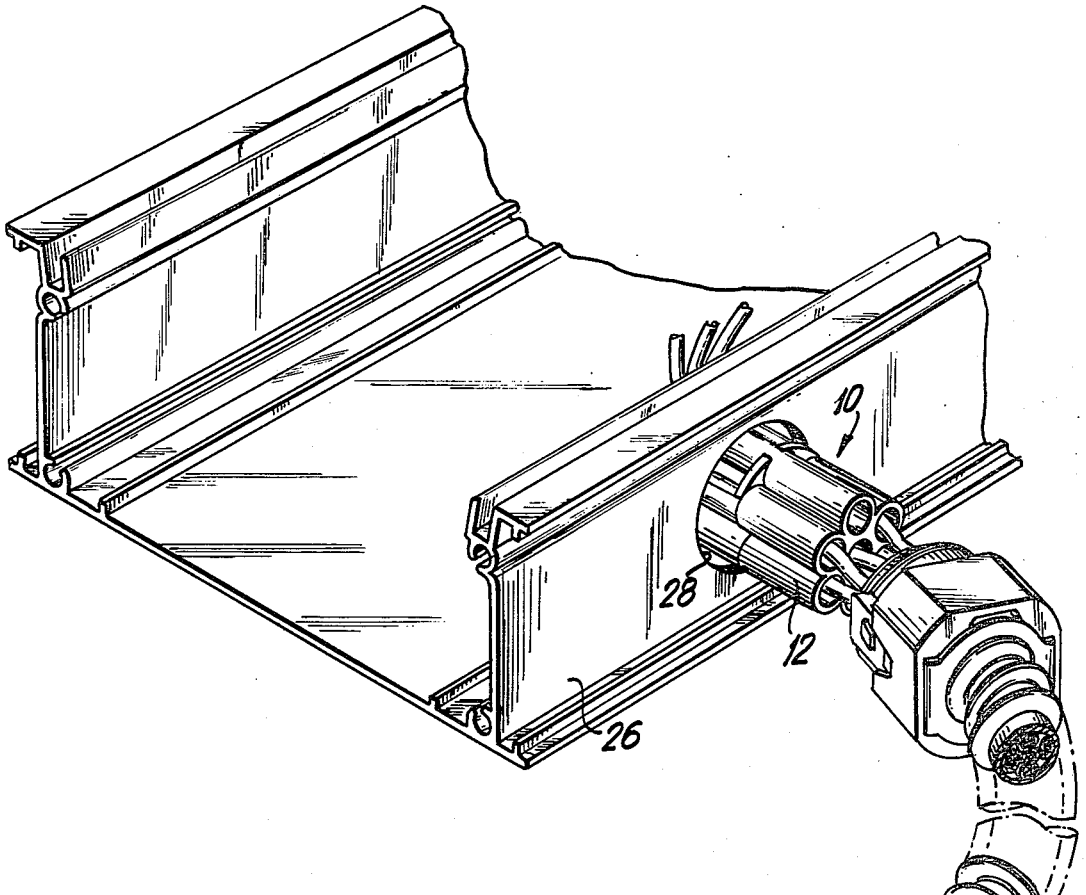
FIG. 1 is a perspective view of an assembly using connectors fabricated according to the present invention.

The present invention relates to an electrical connector designated generally by the reference character 10 which is polarized and has an hermaphroditic support housing 12 which can accommodate male or female contacts 14, 16 for interconnection with male or female contacts 14, 16 in another identical support housing 12. Thus, the connector 10 is structured to interengage with another identical connector 10 in only one relative orientation and carries male and/or female contacts as required. The connector 10 is operable to carry up to six circuits and the polarized nature of the connector 10 ensures that the correct circuits will always be matched and engaged.

Figure 3:
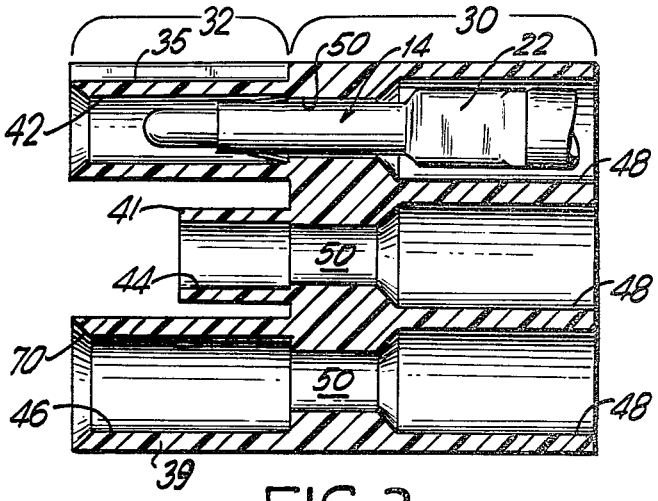
FIG. 3 is a sectional view taken through the line 3—3 of FIG. 2 showing a male electrical contact therein.
Figure 4:
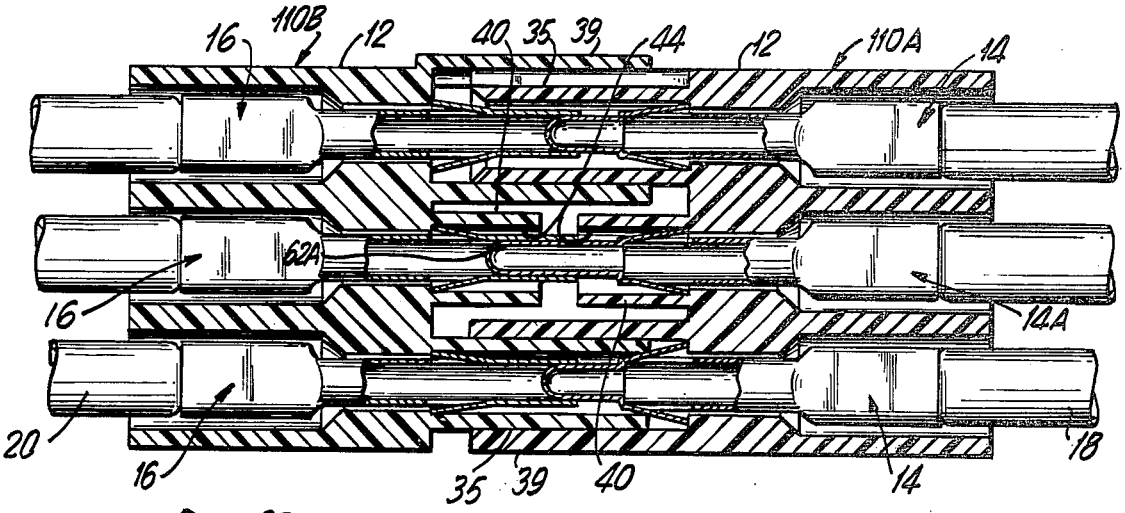
FIG. 4 is a sectional view showing two connectors and the electrical contacts therein partially engaged.
Figure 5:
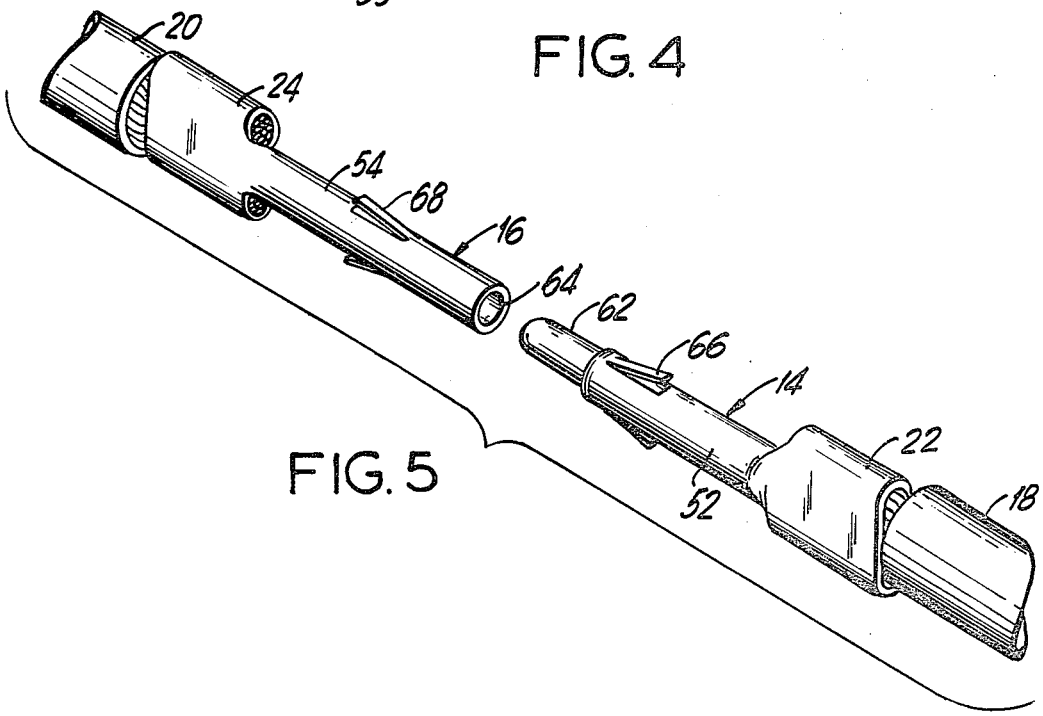
FIG. 5 is a perspective view of male and female electrical contacts, each connected to a lead and aligned for interconnection therebetween.

As briefly outlined above, the preferred embodiment connector 10 has an outer insulating support housing 12 structured to engage with another identical housing 12, and wherein are normally carried two or more electrical contacts, either in the form of a male contact 14 or female contact 16 (FIGS. 4 and 5). The contacts 14 and 16 are so supported in the support housing 12 as to interengage when two connectors 10 interengage, as illustrated in FIG. 3. The respective contacts 14 and 16 are electrically connected to respective electrical conductors 18, 20 (FIG. 5) and, therefore, the interengagement of a male contact 14 with a female contact 16 forms a closed circuit between conductors 18, 20.

As illustrated in FIG. 5, the contacts 14 and 16 are provided preferably with a rear crimping portion 22, 24, respectively, which may be crimped over the respective conductor 18, 20 by use of usual crimping devices. Both contacts 14, 16 have a respective shank 52, 54 on which is carried an associated upstruck flexible and resilient ear 66, 68 and a forward portion in the form of a plug 62 or socket 64, respectively. The contacts 14 and 16 are anchored in bores 42A–C, 44, 46A–C of connector 10 by resilient ears 66, 68, as is described in detail below.

It is contemplated that the support housing 12 will support only either male contacts 14 (connector designated 110A) or female contacts 16 (connector designated 110B). For example, the fixture connector 10 can be provided with the female contacts 16 and the power circuits provided with the male contacts 14. This is not necessary for the operation of the device, but is convenient in practical installation situations. Thus, it will be readily realized by the following that electrical connectors 10 with a mixture of male contacts 14 and female contacts 16 are also possible, if desired. Other convenient arrangements include using male contacts 14 only in the large diameter projections (37–39) described below and female contacts 16 in the small diameter projections (34–36), or vice versa.

Figure 2:
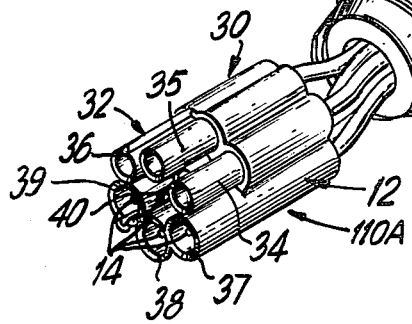
FIG. 2 is a front elevational view of the connector of the present invention, with the electrical contacts omitted for the purpose of clarity.
Figure 2:
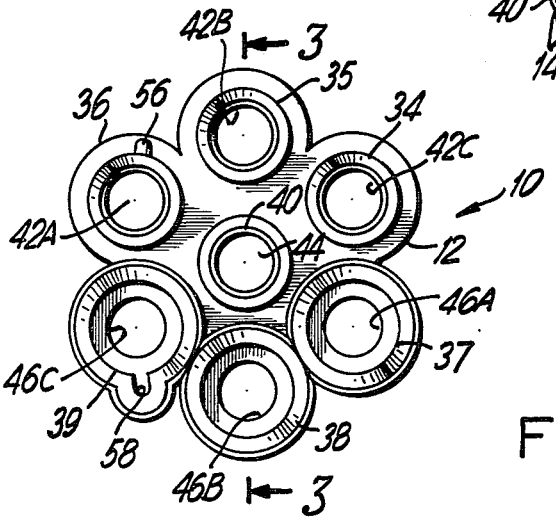

FIG. 1 shows a portion of a lighting fixture 26 with a standard $\frac{7}{8}$ inch opening through which electrical connector 10 (110A, 110B) is sized to fit. To accomplish this size limitation while providing for six circuits in each connector (110A, 110B), a generally circular form is used for the support housing 12, as shown in FIGS. 1 and 2.

The support housing 12 has a generally cylindrical base portion 30 and an integral engaging portion 32 extending therefrom. With reference to FIGS. 1 and 2, the engaging portion comprises an equal number of small diameter cylindrical projections 34, 35, 36, and large diameter cylindrical projections 37, 38, 39, all of substantially the same length and disposed in a generally circular array around a shorter central projection 40. The large diameter cylindrical projections 37–39 each have a central through bore 46A–C with a diameter slightly in excess of the outside diameter of the small diameter cylindrical projections 34–36 whereby the projections 34–36 may be slidingly received in the bores 46A–C. The smaller projections also have central through bores 42A–C. As shown in the drawings, a total of six outer projections 34–39 are present in order to provide for an interconnection of up to six circuits. The central axes of the through bores 42A–C, 46A–C are concentric to the central projection 40 to ensure alignment with mating projections on other connectors 10 (FIG. 2).

The central projection 40 carries the ground circuit for the six active circuits. The central projection 40 is shorter than the outer projections 34–39, as it is not received within another central projection 40 of other connectors 10 with which it can engage, but rather is brought into abutting relationship as can be seen in FIG. 4. Central projection 40 also has a bore 44 defined therethrough.

Polarization is accomplished by providing only one relative orientation between the connectors 110A, 110B at which support housings 12, 12 can interengage. Thus, the cylindrical projections 34–39 are disposed with the large diameter projections 37–39 adjacent each other in an arc and the small diameter cylindrical projections 34–36 similarly arranged. This limitation ensures that the electrical connectors 110A, 110B of this invention can only be interconnected in one orientation with small diameter projections 34–36 received within the bores of the larger diameter projections 37–39.

As noted above, contacts 14 and 16 may be mounted and anchored in each bore 42A–C, 44, 46A–C formed in the small diameter projections 34–36, central projection 40 and large diameter projections 37–39 respectively. Illustrated in FIG. 3 are male and female contact 14, 16 receiving bores generally indicated by 42, 44, 46. As noted above, each of these bores 42A–C, 44, 46A–C extend through small diameter projections 34–36, central projection 40, and large diameter projections 37–39, respectively, to base portion 30. In addition, as illustrated in FIG. 3, each projection bore 42A–C, 44, 46A–C has an identical bore extension structure including a narrowed central passage 50, respectively, which extends through base portion 30 and opens on the back side of base portion 30 at a mouth 48 respectively. The large rearwardly opening mouth 48 of each of the seven bores is sized to receive the normally enlarged crimping portion 22, 24 of the contacts 14 or 16. This relationship is important as the central passages 50, which communicate the mouth portions 48 with a respective bore 42A–C, 44, 46A–C, are sized to closely receive the shank 52, 54 of the respective contacts 14, 16 whereby the contacts 14, 16 are anchored in housing 12 as described below.

Anchoring of contacts 14, 16 is illustrated in FIG. 4. The sizing of the bores 42A–C, 44, 46A–C and bore extensions 50 provides for the receipt of and locking into position of electrically conducting plug and socket members 52, 54. Initially, the electrical conductor 18, 20 is received in the crimped portions 22, 24 of a contact 14 or 16 and crimped to hold it in place, as shown in FIG. 5. Thereafter, the plug end portion 62 or socket end portion 64 is inserted into the appropriate large rear opening mouth 48 and through the narrowed central passage 50 connected therewith, within which passage 50 the spring ears or locking structure 66, 68 is deflected inwardly. When the ears 66, 68 pass completely through the narrowed central passage 50 into the large bore (42A–C, 44, 46A–C), they are released to spring open to lock the contact 14 or 16 in place and prevent removal thereof. The enlarged crimped portions 22, 24 restrain passage of the contacts 14 or 16 through the narrowed central passage 50. In this manner, the contacts 14 and 16 are locked in place in insulated support housing 12 of connector 10.

In operation, one inserts and anchors suitable electrical contact 14, 16, crimped to conductor 18, 20, into a connector 10 as required to make with the other connector 10. As described above, the shaft 52, 54 of the electrical contact is pushed through narrow passage 50 until ears 66, 68 spring out to anchor the contact 14, 16 in place with plug portion 62 or socket portion 64 extending outwardly within its associated bore 42A–C, 44, 46A–C. The small diameter projections 34, 35, 36 of each connector 10A, 10B are aligned with the large diameter bore in the large diameter projection 37, 38, 39 and pushed fully home therein. Alignment is facilitated if the mouth of the large diameter projection is beveled as shown at 70 in FIG. 3. As illustrated in FIG. 4 for connectors 110A, 110B, the interengagement of connectors 110A, 110B causes the end plugs 62 to be received in end sockets 64 to complete various associated circuits.

A safety feature that may be added to the connectors 10 is a key 56 and a keyway 58 provided on one or more mating pairs of cylindrical projections 36, 39. This provides a means to index connectors 10 for different voltages. That is, because connectors 10 are polarized, a particular orientation of mating connectors 110A, 110B is necessary for them to interengage. By putting key 56/keyway 58 arrangements on different sets of connectors, depending on the voltages they are to carry, it is possible to prevent inadvertent mixing of circuits. This provides a fail-safe feature in installations where both 110 volt and 220 volt fixtures are present.

A second safety feature that is preferably incorporated into the connector 110A of the present invention is the use of a male contact 14A in the central projection 40, which male contact 14A has an end plug 62A that is longer than the end plug 62 of the electrical plug members 14 used in the outer projections 34–39. As the central projection 40 normally carries the ground circuit for all the live circuits, this ensures that the ground circuit is connected first and broken last to reduce the danger of electrical shock from faulty electrical fixtures.

While preferred embodiments have been shown and described herein, these are illustrative only, and not intended to be otherwise limiting. Other modifications and changes can be made which would be obvious from this disclosure and are therefore intended to be included within the scope hereof.

What is claimed is:

1. An electrical connector comprising:

a substantially cylindrical insulative housing comprising a base and a plurality of tubular projections extending axially from the base and including one central projection having a first axial extent and an equal number of first and second projections surrounding the central projections in a circle and having a second axial extent greater than that of the central projection, the first and second projections being configured and positioned so that all of the second projections of the housing are receivable in the first projections of a like housing;

a plurality of elongated conductive connector contacts;

and means axially mounting one contact in each projection with one end of each in the base, wherein the other end of each contact in the first and second projections terminates short of the second axial extent and is thereby not exposed and the other end of the contact in the central projection has an axial extent which is greater than that of the other contacts and terminates between the first and second axial extents and thereby projects from the central projection and is exposed while being shielded by the surrounding first and second projections.

2. The connector of claim 1, wherein the diameter of said cylindrical housing is sized to fit within a $\frac{7}{8}$ inch opening.

3. The connector of claim 1 wherein said first projections are disposed adjacent each other in an arc, and said second projections are in close proximity to each other in an arc.

4. The connector of claim 3 wherein there are three first projections and three second projections.

5. The connector of claim 1 or 4 wherein said electrical contact comprise socket members.

6. The connector of claim 1 or 4 wherein said electric contact comprise plug members.

7. The connector of claim 6 wherein said plug members include one plug member having an end portion longer than the end portion of the other plug members, said one plug member being disposed in said central projection.

8. The connector of claim 1 wherein each contact comprises an elongated shaft and spring ears, said spring ears extending from a forward portion of said shaft, and wherein the mounting means comprises a narrowed passage in the base at the base end of each said projection, said shaft extending through said narrowed passage and being anchored therein by said ears.

9. The connector of claim 1 or 8, further comprising a keyway on at least one of said first and second projections and a key receivable in the keyway on the other of said first and second projections.

* * * * *